US011111698B2

(12) United States Patent
Mitchell et al.

(10) Patent No.: US 11,111,698 B2
(45) Date of Patent: Sep. 7, 2021

(54) MULTIPOINT LOCK

(71) Applicant: Endura Products, LLC, Colfax, NC (US)

(72) Inventors: Michael K. Mitchell, Winston-Salem, NC (US); Tomasz Jaskiewicz, Oak Ridge, NC (US); Eric Johnson, Greensboro, NC (US); Adam Kendall, Greensboro, NC (US)

(73) Assignee: Endura Products, LLC, Colfax, NC (US)

( * ) Notice: Subject to any disclaimer, the term of this patent is extended or adjusted under 35 U.S.C. 154(b) by 746 days.

(21) Appl. No.: 15/828,638

(22) Filed: Dec. 1, 2017

(65) Prior Publication Data

US 2018/0155962 A1 Jun. 7, 2018

Related U.S. Application Data

(60) Provisional application No. 62/430,089, filed on Dec. 5, 2016, provisional application No. 62/488,098, filed (Continued)

(51) Int. Cl.
*E05B 63/00* (2006.01)
*E05C 7/06* (2006.01)

(Continued)

(52) U.S. Cl.
CPC ..... *E05B 63/0065* (2013.01); *E05C 7/06* (2013.01); *E05C 9/042* (2013.01); *E05B 63/185* (2013.01);

(Continued)

(58) Field of Classification Search
CPC ... E05C 7/04; E05C 7/045; E05C 7/06; E05C 9/04; E05C 9/042; E05C 9/043;

(Continued)

(56) References Cited

U.S. PATENT DOCUMENTS 284,381 A 9/1883 Clark
1,985,176 A 10/1933 Lamb (Continued)

FOREIGN PATENT DOCUMENTS

CA 2487694 A1 * 5/2005 ..... E05B 65/06
DE 3612761 A1 10/1987

(Continued)

OTHER PUBLICATIONS

Machine Translation of EP 0606877 A2, 2021, pp. 1-14 (Year: 2021).*

(Continued)

*Primary Examiner* — Christine M Mills
(74) *Attorney, Agent, or Firm* — Womble Bond Dickinson (US) LLP

(57) ABSTRACT

A multipoint lock for securing a door panel is described. The multipoint lock includes a first latch, a second latch, a first hub rotatable with at least one of a thumb-turn knob or a key, and a second hub rotatable with a handle lever. Upward rotation of the handle lever causes both rotation of the first hub and rotation of the second hub in the same rotational direction.

19 Claims, 13 Drawing Sheets

Related U.S. Application Data on Apr. 21, 2017, provisional application No. 62/447,955, filed on Jan. 19, 2017.

(51) Int. Cl.

| | |
|---|---|
| ***E05C 9/04*** | (2006.01) |
| *E05B 63/18* | (2006.01) |
| *E05B 1/00* | (2006.01) |
| *E05C 7/04* | (2006.01) |

(52) U.S. Cl.

CPC ..... *E05B 2001/0076* (2013.01); *E05C 7/04* (2013.01)

(58) Field of Classification Search

CPC ..... E05C 9/10; E05C 9/14; E05C 9/16; E05C 9/20; E05C 9/24; E05B 2001/0076; E05B 17/2007; E05B 17/2011; E05B 17/2019; E05B 59/00; E05B 63/08; E05B 63/0065; E05B 63/18; E05B 63/185; E05B 63/20; Y10T 292/0834; Y10T 292/0836; Y10T 292/0837; Y10T 292/0838; Y10T 292/0839; Y10T 292/084; Y10T 292/0844; Y10T 292/0845; Y10T 292/0961; Y10T 292/0962; Y10T 292/0963; Y10T 292/0964; Y10T 292/0967; Y10T 292/1014; Y10T 292/1015; Y10T 292/1016; Y10T 292/102; Y10S 292/21; Y10S 292/44

USPC ..... 292/32–37, 40, 41, 156–159, 161, 292/138–140, 143, 336.3, DIG. 21, 292/DIG. 44; 70/143, 107, 108, 111, 70/467, 468, 475, 481, 482, 483

See application file for complete search history.

(56) References Cited

U.S. PATENT DOCUMENTS 3,435,644 A 4/1969 Hines
3,672,714 A * 6/1972 Schultz ..... E05B 13/004 292/34
3,875,772 A * 4/1975 Ebersman ..... E05B 59/00 70/107
3,910,613 A * 10/1975 Nolin ..... E05B 59/00 292/34
3,999,789 A * 12/1976 Maurits ..... E05B 59/00 292/34
4,109,494 A * 8/1978 Allemann ..... E05B 53/003 70/107
4,353,582 A 10/1982 Eigemeierr
4,850,208 A 7/1989 Weinerman et al.
4,876,783 A 10/1989 Campion et al.
5,265,920 A * 11/1993 Kaup ..... E05B 63/0021 292/40
5,290,077 A 3/1994 Fleming
5,394,718 A 3/1995 Hotzl
5,404,737 A 11/1995 Hotzl
5,474,348 A 12/1995 Palmer et al.
5,490,699 A 2/1996 Uyeda
5,495,731 A * 3/1996 Riznik ..... E05B 63/16 292/39
5,496,082 A * 3/1996 Zuckerman ..... E05B 53/00 292/336.3
5,564,296 A 10/1996 Theriault et al.
5,624,941 A 4/1997 Barth et al.
5,685,584 A 11/1997 Baren et al.
5,715,715 A 2/1998 Nunez
5,782,114 A * 7/1998 Zeus ..... E05C 9/002 70/109
5,933,086 A 8/1999 Tischendorf et al.
6,152,498 A 11/2000 Lindqvist
6,209,931 B1 * 4/2001 Von Stoutenborough ..... E05C 9/041 292/160
6,217,087 B1 4/2001 Fuller
6,250,119 B1 6/2001 Flon
6,266,981 B1 7/2001 Von Resch et al.
6,282,929 B1 9/2001 Eller et al.
6,354,121 B1 3/2002 Frolov
6,443,506 B1 * 9/2002 Su ..... E05B 59/00 292/244
6,454,322 B1 * 9/2002 Su ..... E05B 59/00 292/244
6,478,345 B1 11/2002 Viney
6,532,779 B2 3/2003 Shen
6,557,909 B2 * 5/2003 Morris ..... E05B 59/00 292/169.15
6,688,656 B1 2/2004 Becken
6,725,693 B2 * 4/2004 Yu ..... E05B 47/068 292/144
6,732,557 B1 5/2004 Zehrung
6,758,070 B2 * 7/2004 Yu ..... E05B 47/068 292/144
6,793,253 B2 9/2004 Bruwer et al.
6,929,293 B2 8/2005 Tonges
6,971,686 B2 * 12/2005 Becken ..... E05B 63/20 292/142
7,025,394 B1 4/2006 Hunt
7,051,561 B2 5/2006 Moon et al.
7,293,807 B2 * 11/2007 Hemping ..... E05B 1/003 292/169.14
7,303,215 B2 12/2007 Moon et al.
7,353,637 B2 4/2008 Harger et al.
7,421,868 B2 9/2008 Matyko et al.
7,497,486 B1 3/2009 Davis et al.
7,520,152 B2 4/2009 Sabo et al.
7,526,933 B2 5/2009 Meekma
7,634,928 B2 12/2009 Hunt
7,677,067 B2 * 3/2010 Riznik ..... E05C 9/1841 70/107
7,701,331 B2 4/2010 Tran
7,707,862 B2 5/2010 Walls et al.
7,752,875 B2 7/2010 Constantiou et al.
7,818,984 B2 * 10/2010 Hwang ..... E05B 47/0043 70/107
7,849,718 B2 12/2010 Ambrass
7,856,857 B2 * 12/2010 Tsai ..... E05C 9/026 70/107
7,871,112 B2 * 1/2011 Kondratuk ..... E05B 63/042 292/137
7,878,034 B2 * 2/2011 Alber ..... E05C 7/06 70/107
7,926,315 B2 * 4/2011 Poletti ..... E05B 65/1086 70/107
7,946,080 B2 5/2011 Ellerton et al.
8,035,479 B2 10/2011 Tran
8,061,166 B2 11/2011 Tsai
8,146,392 B2 4/2012 Topfer
8,161,780 B1 4/2012 Huml
8,199,011 B2 6/2012 Lu
8,234,892 B2 * 8/2012 Laverty ..... E05B 63/0065 70/107
8,348,308 B2 1/2013 Hagemeyer et al.
8,358,197 B2 1/2013 Tran
8,382,166 B2 2/2013 Hagemeyer et al.
8,398,126 B2 3/2013 Nakanishi et al.
8,419,087 B2 4/2013 Shen
8,534,099 B2 9/2013 Wheeler et al.
8,534,100 B2 9/2013 Tsai
8,540,288 B2 9/2013 Tsai
8,550,506 B2 * 10/2013 Nakanishi ..... E05B 17/2038 292/32
8,628,126 B2 1/2014 Hagemeyer et al.
8,772,970 B2 7/2014 Lambrou
8,839,562 B2 9/2014 Madrid
8,850,744 B2 * 10/2014 Bauman ..... E05C 9/1841 49/395
8,899,635 B2 12/2014 Nakanishi et al.
8,973,416 B2 3/2015 Terei et al.

(56) References Cited

U.S. PATENT DOCUMENTS

| | | | | |
|---|---|---|---|---|
| 8,997,535 | B2 | 4/2015 | Jeffries | |
| 9,057,210 | B2 | 6/2015 | Dumas et al. | |
| 9,074,391 | B2 * | 7/2015 | Van Parys | E05B 65/06 |
| 9,074,392 | B2 | 7/2015 | Berger | |
| 9,098,953 | B2 | 8/2015 | Kincaid et al. | |
| 9,169,666 | B2 | 10/2015 | Hodgin | |
| 9,169,668 | B2 | 10/2015 | George | |
| 9,212,506 | B2 | 12/2015 | Murphy et al. | |
| 9,218,696 | B2 | 12/2015 | Dumas et al. | |
| 9,222,286 | B2 * | 12/2015 | Uyeda | E05B 65/1086 |
| 9,235,942 | B2 | 1/2016 | Chen et al. | |
| 9,284,750 | B2 | 3/2016 | Maeng et al. | |
| 9,317,984 | B2 | 4/2016 | Cregg et al. | |
| 9,322,194 | B2 | 4/2016 | Cheng et al. | |
| 9,322,195 | B2 | 4/2016 | Ainley et al. | |
| 9,322,201 | B1 | 4/2016 | Cheng et al. | |
| 9,326,094 | B2 | 4/2016 | Johnson et al. | |
| 9,334,676 | B2 | 5/2016 | Lambrou et al. | |
| 9,336,637 | B2 | 5/2016 | Neil et al. | |
| 9,342,936 | B2 | 5/2016 | Scalisi | |
| 9,361,741 | B2 | 6/2016 | Robertson et al. | |
| 9,378,596 | B2 | 6/2016 | Shen et al. | |
| 9,378,597 | B2 | 6/2016 | Shen et al. | |
| 9,378,598 | B2 | 6/2016 | Dumas et al. | |
| 9,382,739 | B1 | 7/2016 | Johnson et al. | |
| 9,396,599 | B1 | 7/2016 | Malhotra | |
| 9,404,284 | B2 * | 8/2016 | Stendal | E05B 15/0013 |
| 9,406,180 | B2 | 8/2016 | Eberwine et al. | |
| 9,428,937 | B2 * | 8/2016 | Tagtow | E05B 59/00 |
| 9,428,940 | B1 | 8/2016 | Patrick | |
| 9,435,142 | B2 | 9/2016 | Carpenter et al. | |
| 9,435,143 | B2 | 9/2016 | Shen | |
| 9,437,062 | B2 | 9/2016 | Ahearn et al. | |
| 9,441,401 | B2 | 9/2016 | Nardelli et al. | |
| 9,447,609 | B2 | 9/2016 | Johnson et al. | |
| 9,470,017 | B1 | 10/2016 | Cheng et al. | |
| 9,472,034 | B2 | 10/2016 | Ahearn et al. | |
| 9,500,007 | B2 | 11/2016 | Lambrou et al. | |
| 9,501,880 | B2 | 11/2016 | Handville et al. | |
| 9,501,883 | B2 | 11/2016 | Handville et al. | |
| 9,502,884 | B2 | 11/2016 | Ghisla et al. | |
| 9,506,278 | B2 | 11/2016 | Mattrisch | |
| 9,512,643 | B1 | 12/2016 | Keefe | |
| 9,514,585 | B2 | 12/2016 | Ahearn et al. | |
| 9,524,601 | B1 | 12/2016 | Dumas | |
| 9,528,294 | B2 | 12/2016 | Johnson et al. | |
| 9,528,296 | B1 | 12/2016 | Cheng et al. | |
| 9,530,262 | B2 | 12/2016 | Johnson | |
| 9,530,264 | B2 | 12/2016 | Caterino et al. | |
| 9,534,420 | B1 | 1/2017 | Cheng et al. | |
| 9,536,363 | B2 | 1/2017 | Ahearn et al. | |
| 9,539,755 | B2 | 1/2017 | Morin et al. | |
| 9,546,504 | B2 | 1/2017 | Overgaard | |
| 9,574,372 | B2 | 2/2017 | Johnson et al. | |
| 9,580,931 | B2 | 2/2017 | Myers et al. | |
| 9,580,934 | B2 | 2/2017 | Baty et al. | |
| 9,593,516 | B2 | 3/2017 | Nakanishi et al. | |
| 9,613,476 | B2 | 4/2017 | Johnson | |
| 9,613,478 | B2 | 4/2017 | Dumas et al. | |
| 9,617,757 | B2 | 4/2017 | Lowder | |
| 9,624,695 | B1 | 4/2017 | Cheng et al. | |
| 9,624,701 | B2 | 4/2017 | Taylor et al. | |
| 9,626,814 | B2 | 4/2017 | Eyring et al. | |
| 9,631,400 | B2 | 4/2017 | Liu et al. | |
| 9,631,920 | B2 | 4/2017 | Goldenson | |
| 9,637,957 | B2 * | 5/2017 | Hagemeyer | E05C 7/04 |
| 9,640,004 | B2 | 5/2017 | Lowder | |
| 9,644,398 | B1 | 5/2017 | Cheng et al. | |
| 9,652,917 | B2 | 5/2017 | Johnson et al. | |
| 9,702,168 | B2 | 7/2017 | Jadallah et al. | |
| 9,758,997 | B2 | 9/2017 | Hagemeyer et al. | |
| 9,765,550 | B2 * | 9/2017 | Hemmingsen | E05B 65/00 |
| 10,669,754 | B2 * | 6/2020 | Lizotte | E05C 9/042 |
| 2002/0104339 | A1 * | 8/2002 | Saner | E05B 65/1086 70/108 |
| 2006/0000247 | A1 | 1/2006 | Moon et al. | |
| 2006/0196236 | A1 * | 9/2006 | Gruenendahl | E05B 55/12 70/107 |
| 2006/0267357 | A1 | 11/2006 | Semtilli | |
| 2008/0211239 | A1 | 9/2008 | Keller | |
| 2012/0280789 | A1 | 11/2012 | Gerhardt et al. | |
| 2013/0026768 | A1 * | 1/2013 | Nolte | E05C 7/04 292/42 |
| 2013/0176107 | A1 | 7/2013 | Dumas et al. | |
| 2013/0234453 | A1 | 9/2013 | Murphy et al. | |
| 2014/0002236 | A1 | 1/2014 | Pineau et al. | |
| 2014/0069154 | A1 | 3/2014 | Dolev | |
| 2014/0077929 | A1 | 3/2014 | Dumas et al. | |
| 2014/0089097 | A1 | 3/2014 | Byun et al. | |
| 2014/0292481 | A1 | 10/2014 | Dumas et al. | |
| 2014/0340196 | A1 | 11/2014 | Myers et al. | |
| 2015/0176311 | A1 | 6/2015 | Picard et al. | |
| 2015/0184425 | A1 | 7/2015 | Ellis et al. | |
| 2015/0252595 | A1 | 9/2015 | Hagemeyer et al. | |
| 2015/0308155 | A1 | 10/2015 | Eller et al. | |
| 2016/0017638 | A1 | 1/2016 | Dore Vasudevan et al. | |
| 2016/0060904 | A1 | 3/2016 | Dore Vasudevan et al. | |
| 2016/0189459 | A1 | 6/2016 | Johnson et al. | |
| 2016/0273243 | A1 | 9/2016 | Geringer et al. | |
| 2016/0312504 | A1 | 10/2016 | Marsh | |
| 2016/0319569 | A1 | 11/2016 | Johnson et al. | |
| 2016/0328901 | A1 | 11/2016 | Johnson | |
| 2016/0350988 | A1 | 12/2016 | Malhotra | |
| 2016/0362914 | A1 | 12/2016 | Carpenter et al. | |
| 2017/0002586 | A1 | 1/2017 | Lee | |
| 2017/0030112 | A1 * | 2/2017 | Kane | E05B 59/00 |
| 2017/0032597 | A1 | 2/2017 | Johnson | |
| 2017/0032602 | A1 | 2/2017 | Chang et al. | |
| 2017/0053468 | A1 | 2/2017 | Johnson | |
| 2017/0053469 | A1 | 2/2017 | Cheng et al. | |
| 2017/0058579 | A1 | 3/2017 | Wolf et al. | |
| 2017/0152681 | A1 | 6/2017 | Chiou et al. | |
| 2018/0187454 | A1 * | 7/2018 | Moon | E05B 63/04 |
| 2018/0187464 | A1 * | 7/2018 | Moon | E05B 59/00 |
| 2018/0202194 | A1 * | 7/2018 | Jaskiewicz | E05B 63/14 |
| 2019/0119952 | A1 * | 4/2019 | Jaskiewicz | E05B 65/06 |

FOREIGN PATENT DOCUMENTS

| | | | | |
|---|---|---|---|---|
| DE | 10139675 | A1 | 2/2003 | |
| DE | 202012007916 | | 10/2012 | |
| EP | 0606877 | A2 * | 7/1994 | E05B 59/00 |
| EP | 0942135 | A1 | 11/1998 | |
| EP | 1182312 | A2 | 4/2001 | |
| EP | 1340871 | A2 | 1/2003 | |
| EP | 1464783 | A2 | 2/2004 | |
| EP | 2264263 | A3 | 4/2010 | |
| EP | 2468989 | A3 | 11/2011 | |
| FR | 3028547 | A1 * | 5/2016 | E05C 9/042 |
| GB | 2323626 | | 9/1998 | |
| GB | 2358668 | | 8/2001 | |
| GB | 2400135 | | 6/2005 | |
| GB | 2483888 | | 3/2012 | |
| WO | WO1992104895 | A1 | 9/1992 | |
| WO | WO2003095774 | A1 | 11/2003 | |
| WO | WO2004025057 | A1 | 3/2004 | |
| WO | WO2005106165 | A2 | 11/2005 | |
| WO | WO2014108263 | A1 | 7/2014 | |
| WO | WO2017068518 | A1 | 4/2017 | |

OTHER PUBLICATIONS

Unikey Residential Access, Smart Lock Pioneer, http://www.unikey.com/industries/residential/: May 19, 2017, 4 pgs.

*Amesbury Hardware Products. Tru-Lock, Multi-Point Swing Door Lock: Amesbury Hardware Products Catalog*; Sep. 2011, 12 pgs.

*Schlage Sense Smart Deadbolt*, http://www.schlage.com/en/home.html., May 19, 2017, 4 pages.

*Lark-Wi Index, Video Smart Lock Smart Keypad Fab App Cloud Solution Production Comparison*, http://lark-wi.com/website/Index.html, May 19, 2017, 16 pgs.

*Danalock V3—smarten up your home*. https://danalock.com/index.html, May 19, 2017, 5 pgs.

(56) References Cited

OTHER PUBLICATIONS

*August Smart Lock & Smart Homes Access Products*. http://august.com/, May 19, 2017, 3 pgs.

* cited by examiner

MULTIPOINT LOCK

INCORPORATION BY REFERENCE

The present disclosure incorporates the disclosures of U.S. provisional application Ser. No. 62/430,089 filed on Dec. 5, 2016, Ser. No. 62/447,955 filed on Jan. 19, 2017, and Ser. No. 62/488,098 filed on Apr. 21, 2017 in their entirety herein.

FIELD OF DISCLOSURE

The present disclosure relates to locks for entryway doors. In some embodiments, the present disclosure relates more particularly to multipoint locks. In some embodiments, the present disclosure relates more particularly to powered locks.

BACKGROUND

Builders have several options when designing entryways for homes or businesses. Typically, entryways either include a single hinged door or a set of double doors. If double doors are present, the two doors are typically arranged with the free, non-hinged edge of each door facing each other. An example prior art entryway 10 having double doors is shown in FIG. 1. An astragal 12 can be positioned between the two doors. The door with the astragal 12 can be referred to as a passive door 14, usually maintained in a closed position with shoot bolts extending from the astragal. The door without the astragal 12 can be referred to as the active door 16, which is more often opened to allow passage through the entryway 10.

Residents and business owners often rely upon cylindrical or mortise type locks, incorporated within the active door 16, in order to secure the entryway 10. In some instances, separate deadbolts are used, in addition to generally centrally located latches, to secure a door panel.

In addition to cylindrical or mortise type locks, builders have found that multipoint locks that have more than one latch or bolt, which are substantially spaced from one another, often provide a more secure closure that is able to seal and secure the entryway better than traditional single-point hardware. Because several latches or bolts are extended or retracted simultaneously, non-trivial effort is sometimes required to operate these multipoint locks.

In addition, smart home technology has begun to interconnect operation of several systems within a home or business. For example, deadbolts for door panels can now be locked or retracted by powered systems based upon an input from a key pad, fob, smart phone, or similar device. Many of the existing powered locks, however, include powered actuation of only a single deadbolt. Prior art powered locks also include substantial packaging placed on the interior or exterior face of the door panel.

The present disclosure provides locks and lock components that seek to improve upon existing locks.

SUMMARY

An embodiment of the present disclosure includes a multipoint lock for securing a door panel. The multipoint lock includes a first latch, a second latch, a first hub rotatable with at least one of a thumb-turn knob or a key, and a second hub rotatable with a handle lever. Upward rotation of the handle lever causes both rotation of the first hub and rotation of the second hub in the same rotational direction Another embodiment of the present disclosure includes a method of operating a multipoint lock. The method of operating the multipoint lock includes the act of locking the multipoint lock by lifting a handle lever. Lifting the handle lever extends at least one latch and causes rotation of a thumb turn drive hub in a first direction. The act of locking the multipoint lock also includes further rotating the thumb turn drive hub in the first direction with one of a key and a thumb-turn knob.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect can be combined with features from any other embodiment or aspect in any appropriate combination. For example, any individual or collective features of method aspects or embodiments can be applied to apparatus, product or component aspects or embodiments and vice versa.

As used herein the term "latch" is defined as a member that slides or pivots into a catch, strike plate, hole, keeper, etc. to fasten or secure a door panel in a closed position relative to the frame of an entryway. The term "latch" as used herein may include structures referred to in the art as latches, latchbolts, and bolts. Latches may or may not be spring loaded unless specifically noted. Latches can extend vertically or horizontally in relation to the door panel of an entryway. As understood by one of ordinary skill in the art, the directions of rotation, relative to a clock, of handles, thumb-turn knobs, and key cylinders can depend upon whether a door panel is mounted for inswing or outswing operation and can be depend upon whether a door is hinged for left hand or right hand operation. Therefore, directional terms such as clockwise and counterclockwise are used in conjunction with their corresponding illustrated embodiment, and alternative mounting arrangements for changing swing or handedness would be understood by one of ordinary skill in the art.

In one embodiment, the present disclosure describes a multipoint lock configured for mounting onto a non-hinged edge of an active or passive door panel to secure the door panel relative to the frame of an entryway. The multipoint lock may include a thumb-turn knob and a handle lever. Upward rotation of the handle lever is configured to cause initial rotation of the thumb-turn knob and extension of at least some of the multiple bolts or latches within the multipoint lock. Further rotation of the thumb-turn knob may result in locking out the multipoint lock.

Figure 1:
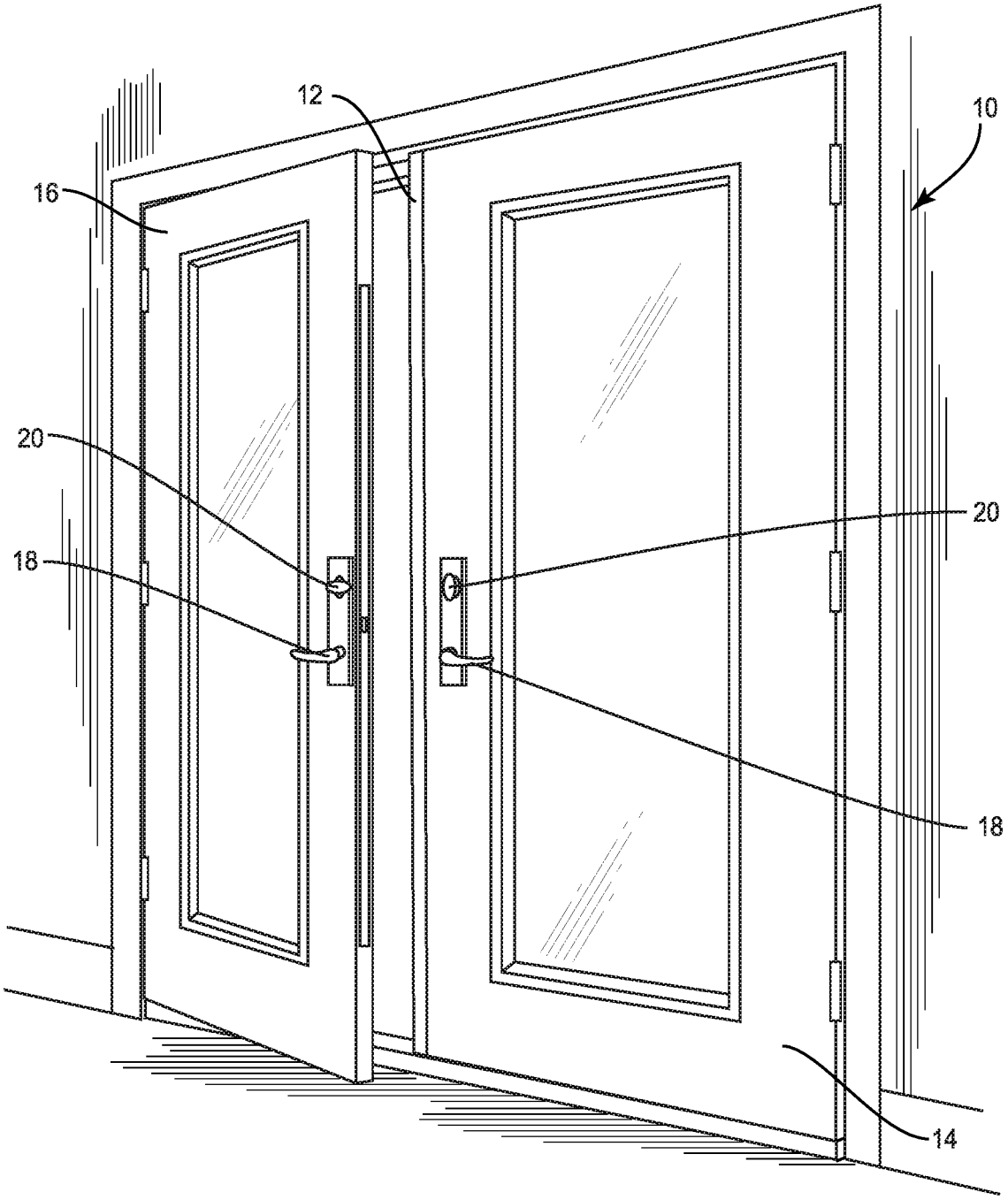
FIG. 1 PRIOR ART
FIG. 1 shows an entryway that can accommodate locks and lock components according to the present disclosure.
Figure 2:
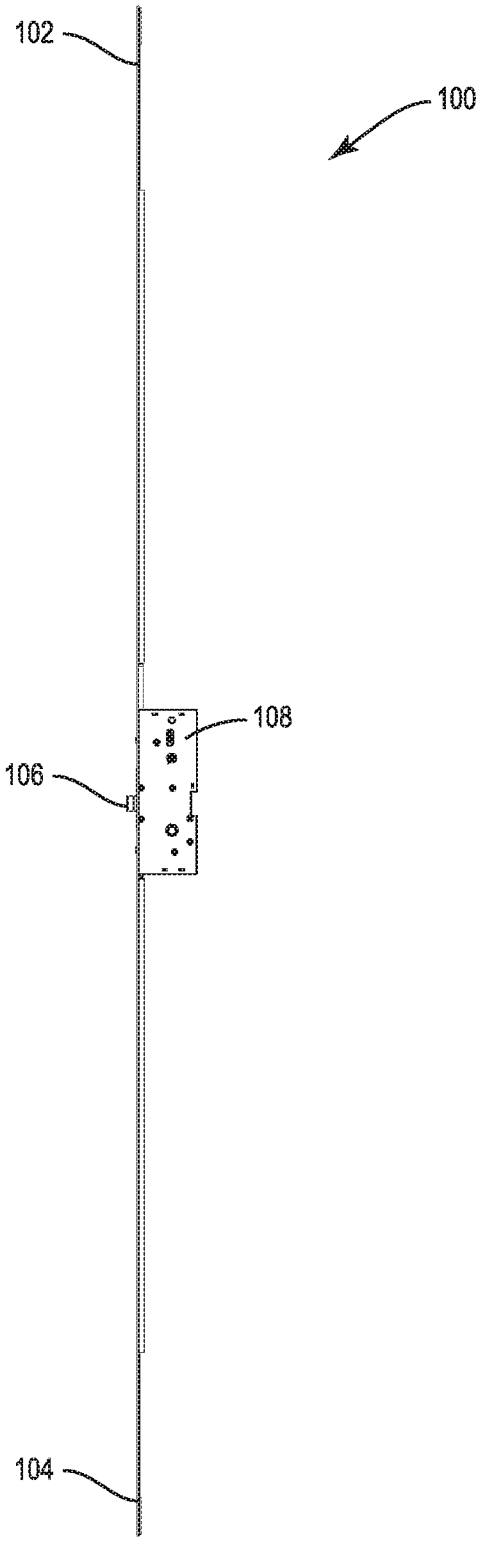
FIG. 2 shows a multipoint lock according to one embodiment of the present disclosure.

FIG. 2 shows a multipoint lock 100 incorporating an upper shoot bolt 102, a lower shoot bolt 104 and a center latch 106. The multipoint lock 100 is suitable for mounting into the non-hinged edge of an active door 16 (FIG. 1). The upper and lower shoot bolts 102, 104 are configured to extend along the vertical direction into a header and a threshold respectively of the entryway 10 (FIG. 1). The upper and lower shoot bolts 102, 104 can be referred to more generally as auxiliary latches. The auxiliary latches can be the shoot bolt type that extend vertically to mate with the header and the threshold as shown. Additionally or alternatively, the auxiliary latches can be of a type that extends and retracts from the non-hinged vertical edge of the active door 16.

The multipoint lock 100 can be operated with a handle lever 18 and a thumb-turn knob 20 (FIG. 1) in operable engagement with a mortise box 108 (FIG. 2). As is generally known in the art, the handle lever 18 can be biased to a neutral, typically horizontal position. The user can then rotate the handle lever 18 downward or upward. Though a handle lever 18 is illustrated, knobs may be used in place of the handle lever. In some embodiments, the thumb-turn knob 20 may be replaced by a key cylinder lock set.

Figure 3A:
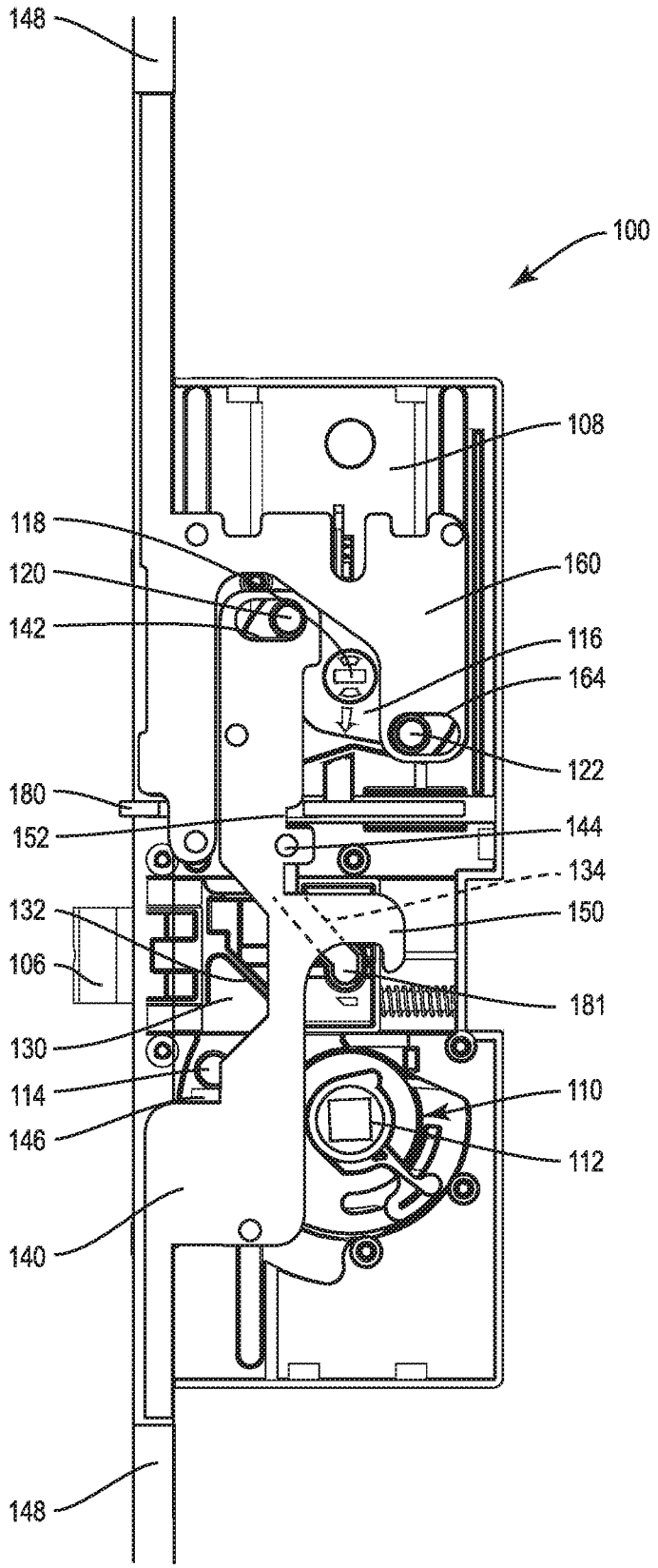
FIG. 3A shows a detailed view of the mortise box of the multipoint lock of FIG. 2 with the mortise box cover removed.
Figure 3B:
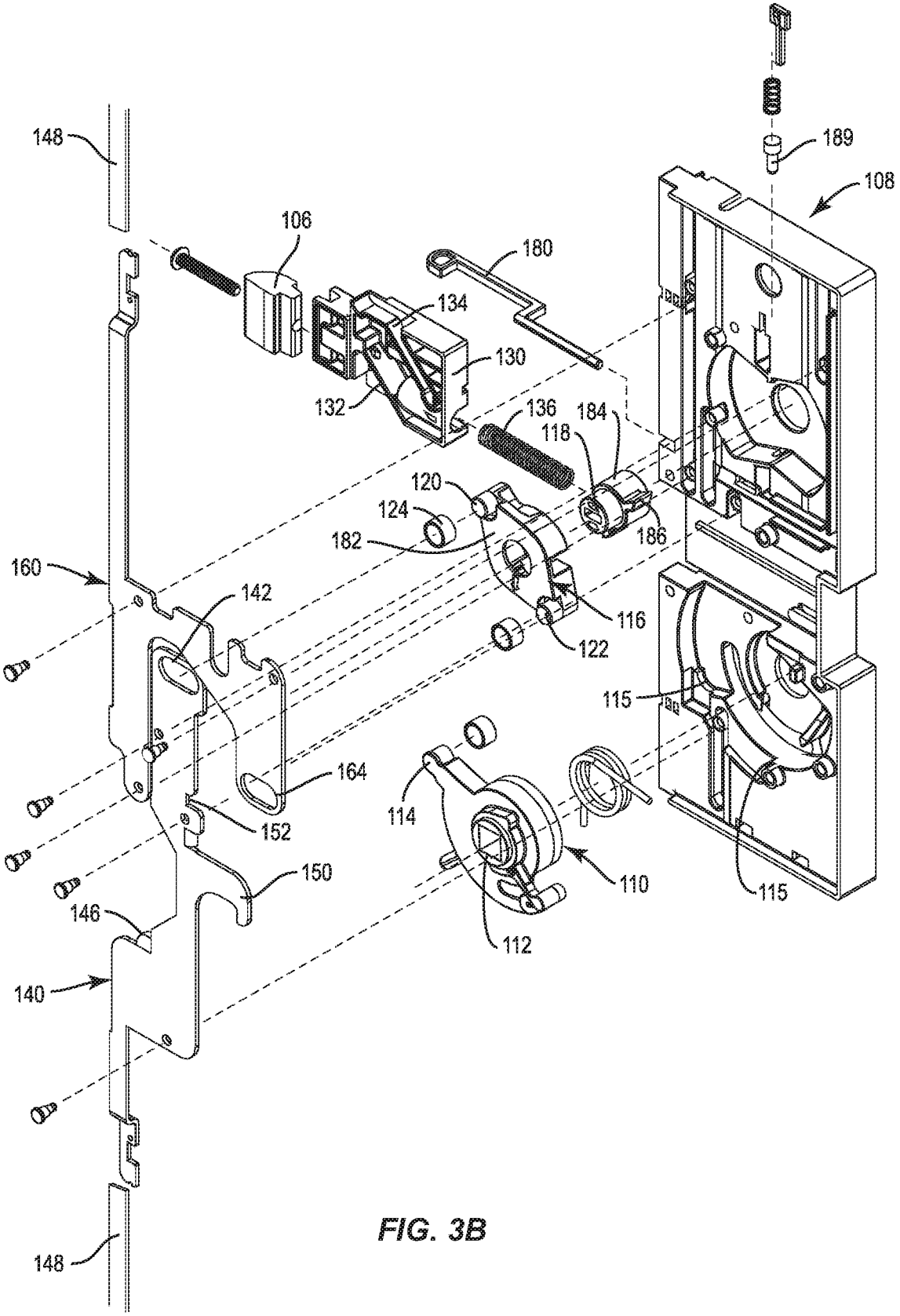
FIG. 3B shows an exploded view of the components of the mortise box shown in FIG. 3A.

FIG. 3A shows an interior of the mortise box 108 with the cover removed. FIG. 3B shows an exploded view of the components within the mortise box 108. As shown in both FIGS. 3A and 3*b*, the mortise box 108 houses a handle set drive hub 110 intended to be in operable engagement with the handle lever 18 (FIG. 1) such that a spindle from the handle lever passes through an aperture 112 in the handle set drive hub. As the handle lever 18 is rotated, the handle set drive hub 110 similarly rotates. The handle set drive hub 110 is shown in an initial position in FIG. 3B. The initial position also may be referred to as a home position or latched position. In the initial position, the handle lever 18 is typically arranged in a horizontal manner. The initial position of the handle set drive hub 110 may correspond with the latch 106 in a latched position. The handle set drive hub 110 is biased to the initial position by a spring (not shown) or other handle return means known in the art. The handle set drive hub 110 also includes a handle boss 114 used to provide an abutment surface. In one embodiment, the mortise box 108 is configured to accept the handle set drive hub 110 and provide one or more stop surfaces 115 (FIG. 3B) to limit the magnitude of rotation of the handle set drive hub within the mortise box.

Continuing with FIGS. 3A and 3B, a thumb-turn drive hub 116 is intended to be in operable engagement with the thumb-turn knob 20 (FIG. 1), to rotate therewith. Although a thumb-turn knob 20 is common for operating lock components from an interior of a door panel, the thumb-turn drive hub 116 is not limited to operation in conjunction with a thumb-turn knob 20, but may be operated with a key from the interior and exterior of the door panel. The thumb-turn drive hub 116 is configured to receive a spindle from the thumb-turn knob 20 through a bore 118. The thumb-turn drive hub 116 may include a first boss 120 and a second boss 122. The bosses 120, 122 may extend from the same surface, at opposite ends thereof, of the thumb-turn drive hub 116. The bosses 120, 122 may be integral with the thumb-turn drive hub 116 or may be formed from pins attached to the thumb-turn drive hub. The bosses 120, 122, as well as the handle boss 114, may be surrounded by bushings 124 configured to rotate around each boss.

The center latch 106, according to the illustrated embodiment of FIG. 3A, is mounted for sliding movement relative to the mortise box 108 along a horizontal direction. The center latch 106 can be attached to or integrated with a latch carrier 130. The latch carrier 130 may include a carrier abutment surface 132 configured for interaction with the handle boss 114 of the handle set drive hub 110. The latch carrier 130 may also include a camway 134. The center latch 106 and latch carrier 130 may be biased to the illustrated latched position of FIG. 3A by a spring 136 (FIG. 3B).

Continuing with FIG. 3A, a first drive plate 140 may be provided to selectively coordinate operation of the thumb-turn drive hub 116, the center latch 106, and the handle set drive hub 110. In the illustrated embodiment of a multipoint lock 100, the first drive plate 140 further selectively coordinates movement of the lower shoot bolt 104 (FIG. 2). The first drive plate 140 may include a first actuation slot 142 for receiving the first boss 120 of the thumb turn drive hub 116. The first drive plate 140 may also include an actuation pin 144 configured to selectively travel within and bear against the camway 134 of the latch carrier 130. The first drive plate 140 may further comprise a protrusion 146 that can provide an abutment surface for selectively contacting the handle boss 114 of the handle set drive hub 110. The first drive plate 140 may be relatively fixed to a first drive bar 148 leading to the lower shoot bolt 104. A stop arm 150 may extend from the first drive plate 140 as discussed in further detail below. A retaining notch 152 may also be formed in the first drive plate 140 as discussed in further detail below.

If an upper shoot bolt 102 (FIG. 2) is included as part of the multipoint lock 100, a second drive plate 160 (FIGS. 3A and 3B) can be slidably provided within the mortise box 108 to selectively drive the upper shoot bolt 102. Therefore, the second drive plate 160 may be fixed relative to a drive bar 148, which may lead to and drive the upper shoot bolt 102 upon sliding motion thereof. The second drive plate 160 may include a second actuation slot 164 for receiving the second boss 122 of the thumb turn drive hub 116.

Staying with FIGS. 3A and 3B, an anti-slam device 180 may be provided to prevent extension of the shoot bolts 102, 104 (FIG. 2) from their recessed or latched positions unless the active door 16 (FIG. 1) is closed. In the illustrated embodiment, closing the active door 16 depresses the anti-slam device 180, which is biased by a spring (not shown) to extend from the unhinged edge of the active door, and withdraws the anti-slam device 180 from engagement with the retaining notch 152 of the first drive plate 140. When the anti-slam device 180 engages the retaining notch 152, the first drive plate 140 is prevented from moving vertically, and the second drive plate 160 is similarly fixed in position.

Figures 4A, 4B, 4C, 4D:
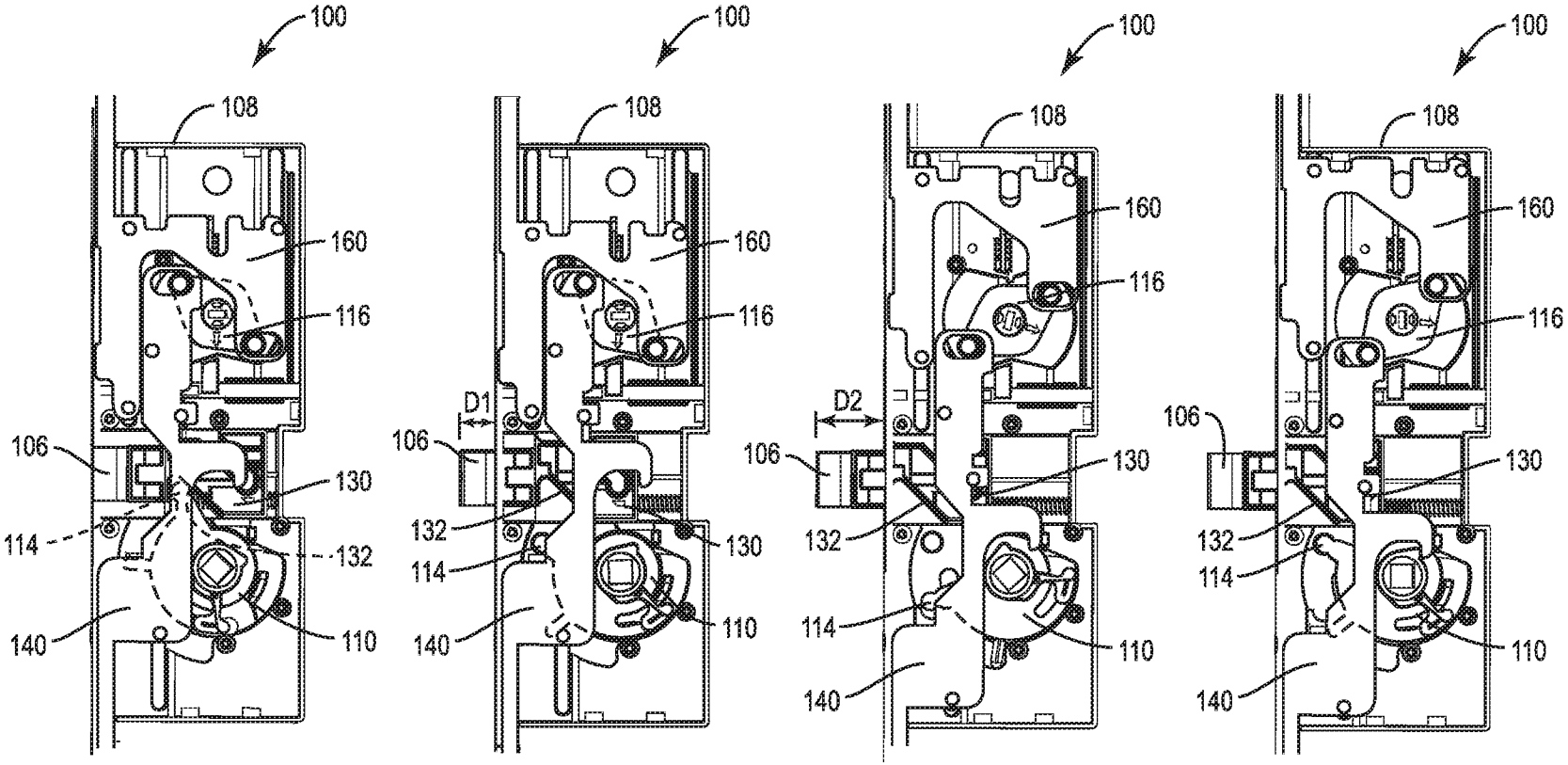
FIG. 4A shows the multipoint lock of FIG. 2 in a retracted position.
FIG. 4B shows the multipoint lock of FIG. 2 in a latched position.
FIG. 4C shows the multipoint lock of FIG. 2 in an extended position.
FIG. 4D shows the multipoint lock of FIG. 2 in a locked position.

FIGS. 4A-4D illustrate the operation of the multipoint lock 100. FIG. 4A shows the multipoint lock 100 in a retracted position. The multipoint lock 100 assumes the retracted position to open the active door 16 (FIG. 1) from a closed position thereof. The retracted position occurs when the handle lever 18 (FIG. 1) is rotated downward while the thumb-turn knob 20 is in an unlocked position thereof. In the illustrated embodiment, turning the handle lever 18 downward rotates the handle set drive hub 110 clockwise approximately 45 degrees. Interaction between the handle set drive hub 110 and the latch carrier 130, particularly a contact force between the handle boss 114 and the abutment surface 132, retracts the center latch 106 into the mortise box 108.

In the retracted position shown in FIG. 4A, the shoot bolts 102, 104 (FIG. 2) are initially retracted, e.g. recessed relative to the door panel, as understood from both the first and second drive plates 140, 160 being positioned relatively toward a center of the mortise box 108, and toward one another.

FIG. 4B shows the initial, latched positioned. The latched position may also be referred to as the unlocked position. With the handle lever 18 (FIG. 1) in a neutral, horizontal position, the center latch 106 extends to its home position, a non-zero distance D1 from the unhinged edge of the door panel. The shoot bolts 102, 104 (FIG. 2) remain retracted according to the illustrated embodiment, but may also extend from the door panel in the latched position if the shoot bolts yield as the door panel is being closed. As mentioned above, springs or other biasing means (not shown) can return the handle lever 18 from the downward position corresponding with FIG. 4A to the neutral position corresponding with FIG. 4B by rotating the handle set drive hub 110 counter-clockwise according to the illustrated example.

An extended position of the multipoint lock 100 is shown in FIG. 4C. The extended position may be also referred to as the deadbolt position or pre-locked position. In the extended position, the handle lever 18 (FIG. 1) is rotated upward, such as approximately 45 degrees, resulting in counterclockwise rotation of the handle set drive hub 110 when comparing FIG. 4B to FIG. 4C. The magnitude of upward rotation of the handle set drive hub 110 may be intentionally limited by the one or more stop surfaces 115 (FIG. 3B) of the mortise box 108 abutting one or more portions of the handle set drive hub 110, such as the handle boss 114. Counterclockwise rotation of the handle set drive hub 110 from the neutral position pushes the first drive plate 140 down, extending the lower shoot bolt 104 by a first magnitude from the bottom of the door panel. The first drive plate 140 is pushed down as the handle boss 114 of the handle set drive hub 110 bears against the abutment surface provided by the protrusion 146 of the first drive plate 140. Downward movement of the first drive plate 140 can also extend the center latch 106 outward beyond its initial position. The center latch 106 may be forced outward as the actuation pin 144 slides along and bears against the camway 134. The extended position of the center latch 106 may provide an extension of a second distance D2 from the unhinged edge of the door panel. The connection between the first drive plate 140 and the thumb-turn drive hub 116, provided by the bearing of the first actuation slot 142 on the first boss 120, causes the thumb-turn drive hub, and therefore the thumb-turn knob 20 (FIG. 1), to rotate as the first drive plate 140 is pushed downward.

The illustrated arrangement between the first drive plate 140, the thumb-turn drive hub 116, and the second drive plate 160 shown in FIGS. 3A and 4A-C can force the second drive plate upward as the first drive plate is forced downward. Particularly, rotation of the thumb-turn drive hub 116 caused by the lower of the first drive plate 140 causes the second boss 122 to bear against the second actuation slot 164 to force the second drive plate 160 upward. Upward motion of the second drive plate 160 may extend the upper shoot bolt 102. Therefore, the extended position of FIG. 4C created by upward rotation of the handle lever 18 (FIG. 1) can result in extension of the lower shoot bolt 104 (FIG. 2), extension of the center latch 106, extension of the upper shoot bolt 102, and approximately a 45-degree rotation of the thumb-turn drive hub 116 and thumb-turn knob 20, in a driven direction. The driven direction is the same direction of rotation as the upward pull upon the handle lever 18, which in the illustrated embodiment creates counterclockwise rotation.

FIG. 4D shows a locked position of the multipoint lock 100, also referred to as a lockout position. To obtain the locked position, the thumb-turn knob 20 (FIG. 1), and therefore the thumb-turn drive hub 116, can be rotated approximately an additional 45 degrees in the driven direction, counterclockwise in the illustrated example. The additional manual rotation of the thumb-turn knob 20 (or key) and the thumb-turn drive hub 116 can force the second drive plate 160 further upward relative to the mortise box 108 and can force the first drive plate 140 further downward relative to the mortise box. This movement of the first and second drive plates 140, 160 can further extend the upper shoot bolt 102 (FIG. 2) and lower shoot bolt 104 by a second, larger magnitude from the top and bottom edges of the door panel respectively. The additional downward motion of the first drive plate 140 caused by manual rotation of the thumb-turn knob 20 may or may not push the center latch 106 outward farther, beyond its extended position, depending upon the shape of the camway 134. In the illustrated embodiment, the camway 134 includes a vertical extension 181 such that the center latch 106 is not extended farther between the extended and locked positions. The shape of the vertical extension 181 may help prohibit back-driving the center latch 106 when the multipoint lock 100 is in the locked position.

As shown in FIG. 4D, when the first drive plate 140 is positioned in the locked position, and possibly the extended position as well, the stop arm 150 is configured to contact the handle set drive hub 110 such that the handle lever 18 (FIG. 1) can rotate from the upward position to the neutral position, but is substantially prevented from rotating from the neutral position downward. Therefore, when the thumb-turn knob 20 is in the locked position, the handle lever 18 may be prevented from rotating downward to achieve the otherwise retracted position of the multipoint lock 100. By preventing downward rotation of the handle lever 18, the user is reminded that the multipoint lock 100 is in the locked position.

Advantages, according to some embodiments, may occur by limiting upward rotation of the handle set drive hub 112 to the position shown in FIG. 4C, and only locking out the multipoint lock 100 with the additional rotation of the thumb turn drive hub 116. First, the initial upward rotation of the handle set drive hub 112 makes use of the mechanical advantage provided by a handle lever 18 to significantly reduce the effort that would otherwise be required to manually rotate the thumb turn drive hub 116 the full 90 degrees to lockout the multipoint lock 100 from the latched position. Second, users may be unaccustomed to the effects of lifting a handle lever 18. Therefore, to prevent users from unintentionally locking themselves out of a building, it may be advantageous that lifting the handle lever 18 alone does not fully lock out the multipoint lock 100. Thus, it may be preferred that the latches can still be withdrawn by a downward rotation of the handle lever 18 after a prior lifting of the handle lever, unless the thumb turn drive hub 116 was caused to complete its rotation, e.g. 90 degrees from the initial unlocked position.

Figure 4E:
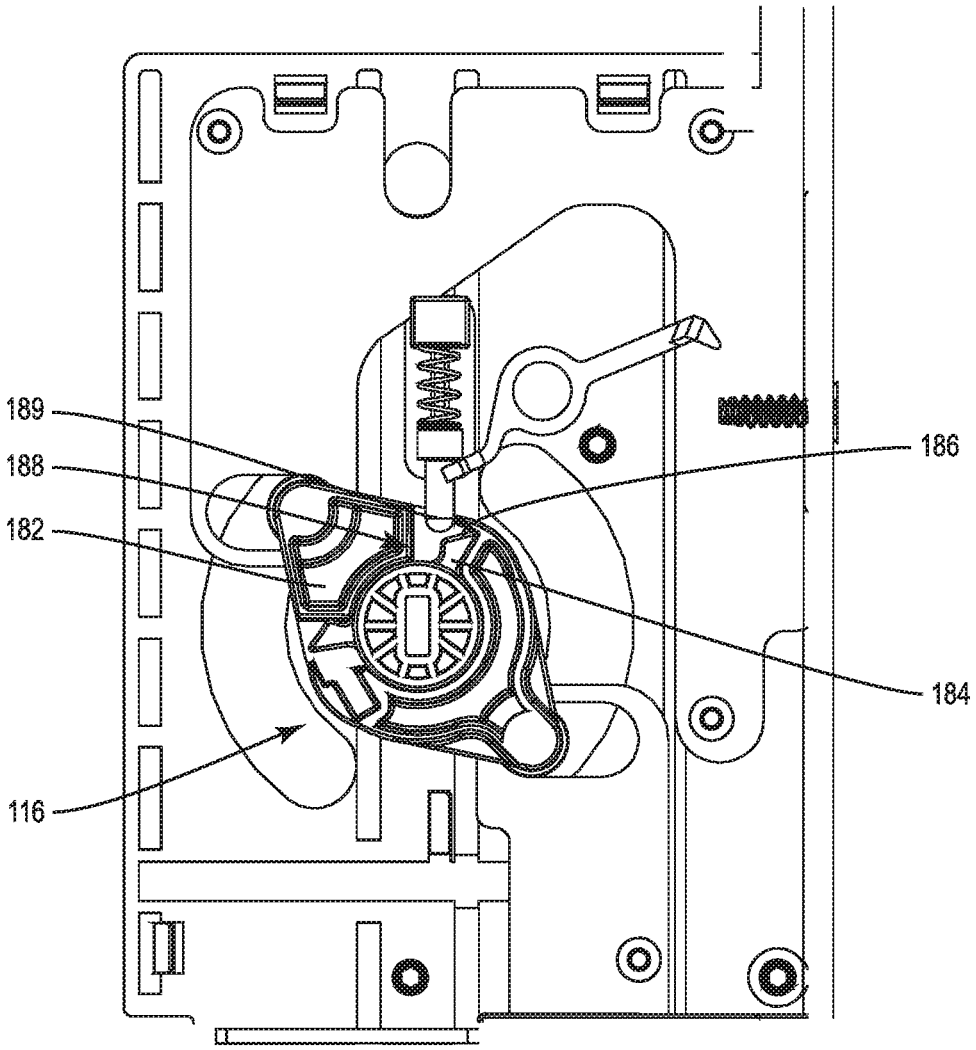
FIG. 4E shows a detailed rear view of the multipoint lock of FIG. 2 in the locked position.

FIG. 4E shows additional details of the multipoint lock 100 in the locked position. Particularly, the thumb turn drive hub 116 is shown as an assembly comprising an outer body 182 and an inner body 184. The inner body 184 includes at least one pawl 186 adjacent to a groove 188 in the outer body 182. When in the locked position as shown in FIGS. 4D and 4E, a lockout pin 189 is biased into the groove 188. Placement of the lockout pin 189 in the groove 188 may help prevent undesired rotation of the thumb turn drive hub 116, such as resulting from unwanted attempts to forcibly depress the center latch 106.

To return from the locked position of FIG. 4D to the latched, unlocked position of FIG. 4B, the thumb-turn drive hub 116 can be rotated by the user, with a key or thumb turn knob 20, approximately 90 degrees in a direction opposite the driven direction. In the illustrated embodiment, clockwise rotation of the thumb-turn knob 20 would release the center latch 106 back to the latched position, and pull the shoot bolts 102, 104 back to their retracted position. Where provided, the pawl 186 (FIG. 4E) on the inner body 184 of the thumb turn drive hub 116 may be shaped to force the lockout pin 189 out of the groove 188 upon rotation of a key or thumb turn knob 20 (FIG. 1).

The operation of the multipoint lock 100 described above, should be understood as reflective of the operation of the lock from an interior side of the door panel. In some embodiments, the multipoint lock 100 may be operated similarly from the exterior of the door panel. For example, locking out the multipoint lock may occur by lifting the exterior handle lever, then turning a key cylinder. In other embodiments, locking and unlocking the multipoint lock 100 from the exterior side of the door may involve use of the key cylinder without the requirement or ability to lift the exterior handle lever.

Figure 5:
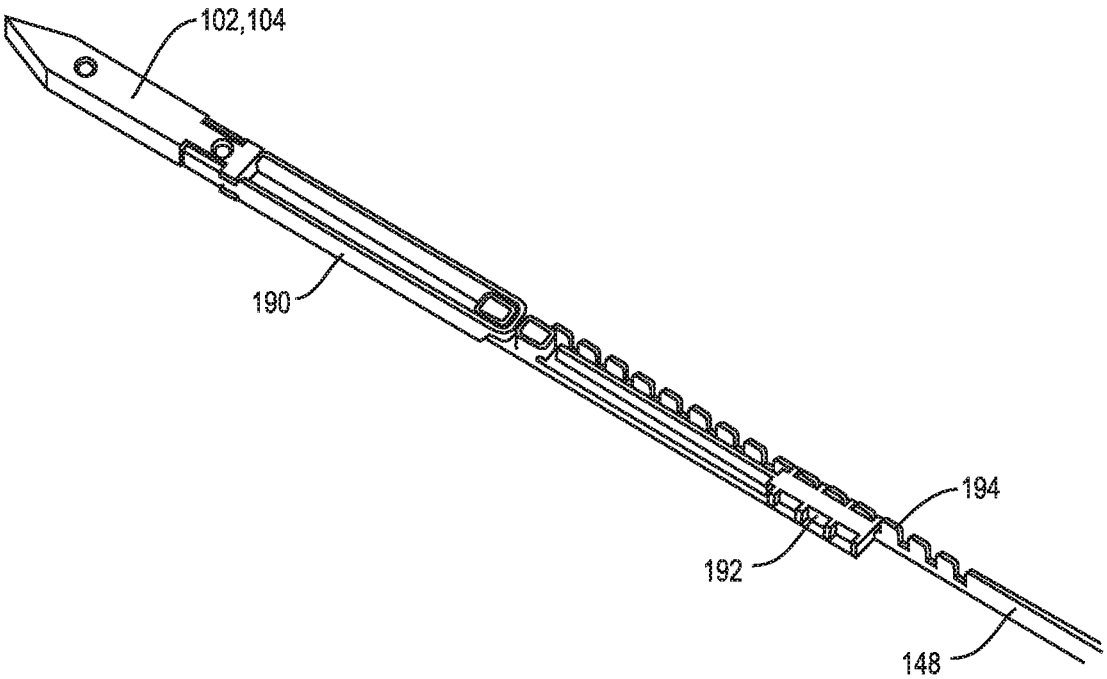
FIG. 5 shows a detailed view of a shoot bolt suitable for use in the multipoint lock of FIG. 2

Turning to FIG. 5, in some embodiments, the shoot bolts 102, 104 may be configured to be adjustable to accommodate door panels of various heights, which would cause different dimensions between the first and second drive plates 140, 160 (FIG. 3A) and the top and bottom edges of the door panel. FIG. 5 shows one example involving an adjuster link 190 coupled to the shoot bolt 102, 104. The adjuster link 190 includes link teeth 192 configured to selectively engage bar teeth 194 formed along the end of the drive bars 148. The teeth 192, 194 may be retained in engagement with one another by a lock channel of the multipoint lock 100, by a friction fit, or by being configured as interlocking structures.

Figure 6:
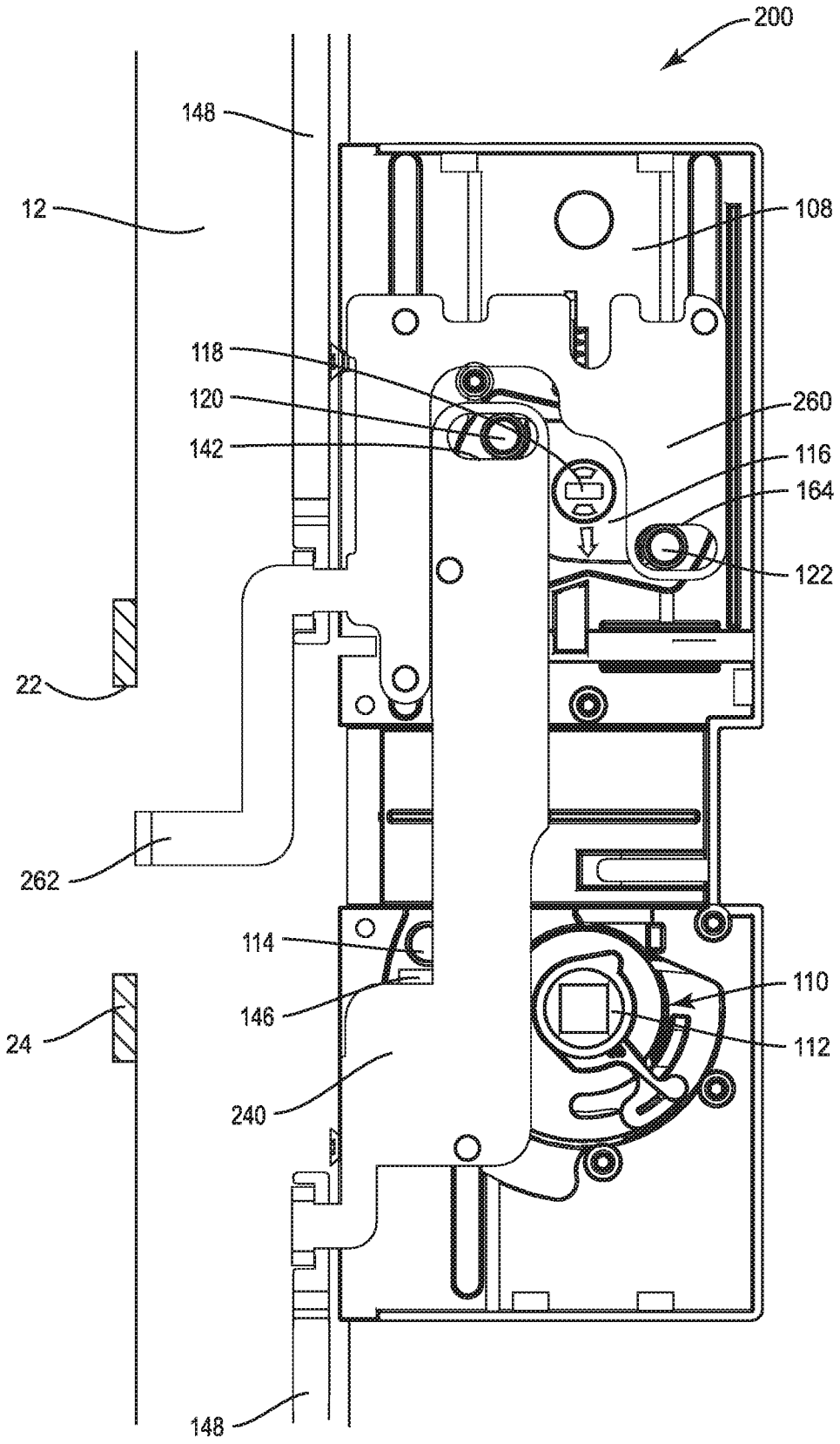
FIG. 6 shows a detailed view of an embodiment of a mortise box useful for passive door panels with the mortise box cover removed.

As shown in FIG. 6, a multipoint lock 200 may be configured for use in connection with a passive door 14, such as being incorporated into an astragal 12. The multipoint lock 200 is similar to the multipoint lock 100 described above, but where used to secure a passive door 14, the center latch 106 would be omitted. The anti-slam device 180 would also likely be omitted. The drive plates 240, 260 may be simplified due to the reduced functionality required of the passive door multipoint lock 200. Otherwise, the shoot bolts 102, 104 (FIG. 2) could be extended and retracted in the same manner as discussed above. For example, the shoot bolts 102, 104 may be extended as a result of lifting the handle lever 18 (FIG. 1) followed by turning the thumb-turn knob 20 by an additional amount. The shoot bolts 102, 104 may be retracted by turning the thumb-turn knob 20 approximately 90 degrees in the opposite direction. Again, the described order of operations is suggested when the user is on the interior side of the door panel. A user on the outside of the door panel may operate the lock with a key, or may not be able to operate the lock on the passive door at all.

In one embodiment, the second drive plate 260 may include an extension 262. In the unlocked position shown in FIG. 6, the extension 262 may be configured to reside within a window 22 of a strike plate 24 attached to the astragal 12. The extension 262 is configured to prevent the center latch 106 of the multipoint lock 100 (FIG. 2) from extending to the locked position while the multipoint lock 200 is unlocked. When the multipoint lock 200 is locked, the second drive plate 260 may rise, positioning the extension 262 above the window 22 and creating a clear path for the extension of the center latch 106 to the locked position thereof.

Figure 7:
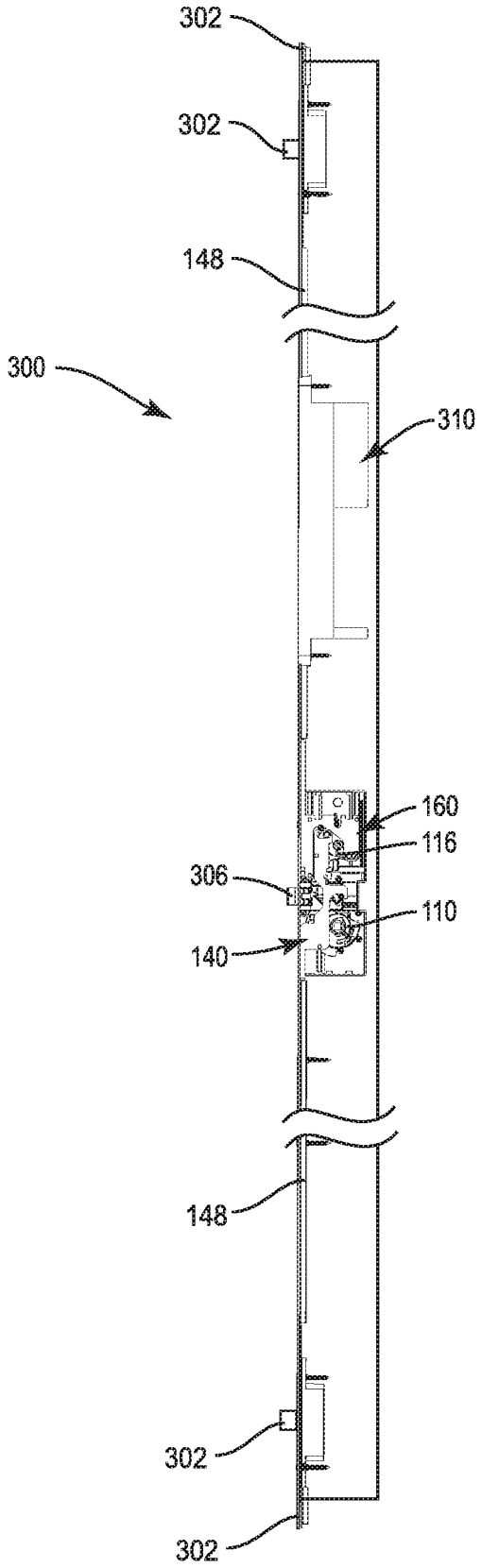
FIG. 7 shows a multipoint lock according to another embodiment of the present disclosure with a powered actuator added.

FIG. 7 shows a third embodiment of a multipoint lock 300 that is capable of being selectively operated manually, as discussed above with respect to the multipoint lock 100, and also by a powered actuator, to drive a plurality of bolts, latches, or latch bolts substantially simultaneously. In some embodiments, the multipoint lock 300 is substantially fully packaged within a mortise groove formed in the unhinged edge of a door panel. This packaging arrangement can prevent altering the appearance of the interior or exterior face of the door panel. This packaging arrangement can also accommodate the use of existing hardware, such as handle levers 18, key cylinders, and thumb-turn knobs 20 as shown in FIG. 1.

As shown in FIG. 7, the multipoint lock 300 can include at least one auxiliary latch 302 in the form of a latch extending from the unhinged edge of the door panel. Additionally or alternatively, the at least one auxiliary latch 302 may be in the form of a shoot bolt configured to extend upward or downward from the door panel along a height direction thereof. By way of example, the auxiliary latches 302 can be operably connected to the drive bars 148 (FIG. 3A). The multipoint lock 300 may include the same components for manual operation as the multipoint lock 100 described above. Therefore, the drive bars 148 may be fixedly connected to respective drive plates 140, 160, which may be translated within a mortise box 108 (FIG. 2) through rotation of one or both of the thumb turn drive hub 116 and the handle set drive hub 110.

Unlike the multipoint lock 100 of the first embodiment, the multipoint lock 300 of FIG. 7 includes a powered actuator 310 configured to selectively operate the multipoint lock 300, such as translating at least one of the drive bars 148 to ultimately extend and retract the at least one auxiliary latch 302. As discussed above, translation of the drive bars 148 may also transition a center latch 306 between a latched position and an extended position.

Figure 8:
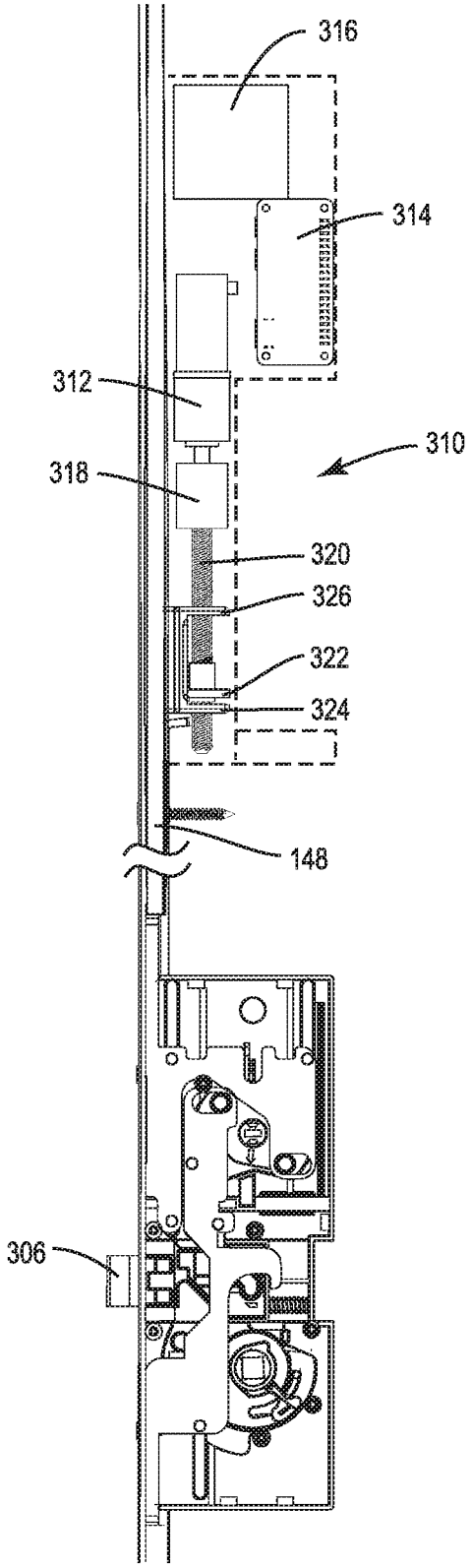
FIG. 8 shows a more detailed view of the mortise box and powered actuator of the embodiment of FIG. 7.
Figure 9:
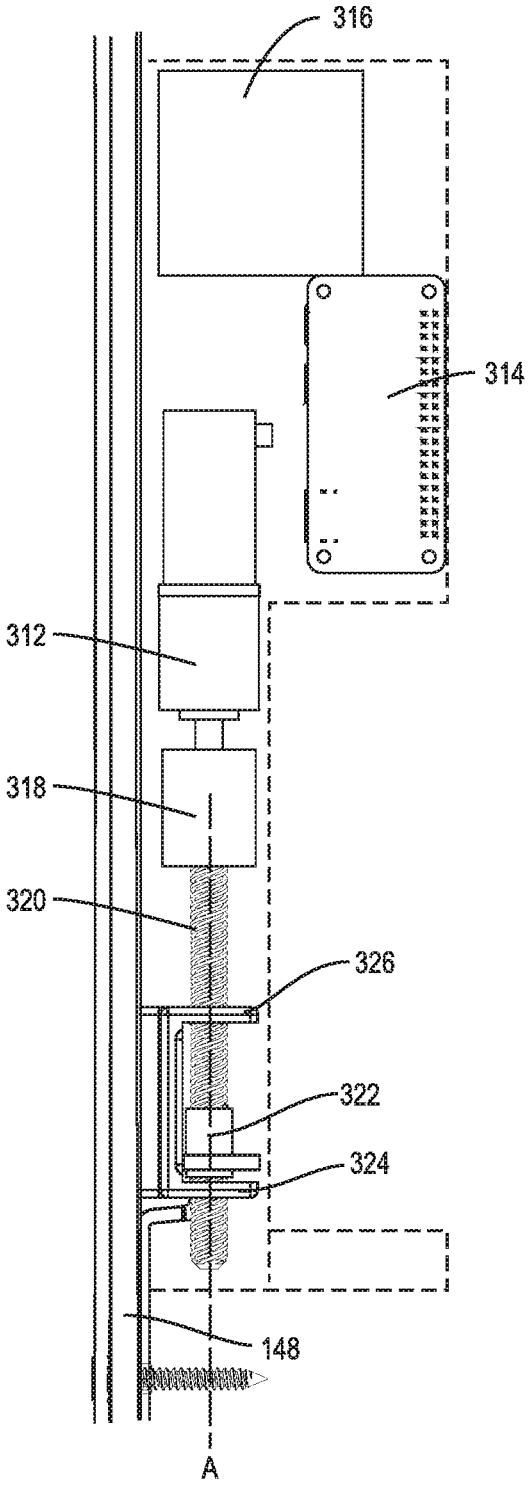
FIG. 9 shows a more detailed view of the powered actuator of the embodiment of FIG. 7.

As shown in FIGS. 8 and 9, the powered actuator 310 may be configured to be coupled to one of the drive bars 148. When triggered, the powered actuator 310 is configured to raise or lower the respective drive bar 148 to actuate at least one of the center latch 306 or the auxiliary latches 302 (FIG. 7). For example, the powered actuator 310 may cause the auxiliary latches 302 to extend to a locked position or retract to a recessed position, and may cause the center latch 306 to extend to a locked position or withdraw to the latched position.

The powered actuator 310 of the illustrated embodiment can include a motor 312, a controller 314, and a power source 316, such as a battery pack. The motor 312 can engage a coupler 318 which is attached to a drive screw 320. A drive nut 322 can be mounted along the drive screw 320. A drive bar connector 324 can be fixed to the drive bar 148 and configured to slide along the drive screw 320. The drive bar connector 324 can have a pair of spaced apart actuation surfaces 326.

The controller 314 can be configured to receive a wired or wireless signal and initiate operation of the motor 312 to rotate the drive screw 320. In some embodiments, the controller 314 receives a signal from a user interface, such as a key pad, disposed on a face of the door panel. In other embodiments, the controller 314 is configured to receive a wireless signal. The controller 314 can be configured to control the motor 312 to operate in two rotational directions, which in turn provides linear movement of the drive nut 322 in two linear directions, e.g. up and down. The controller 314 can be configured to sense and control the rate and direction of rotation of the motor 312 in response to external signals. The controller 314 can also be configured to sense and control the rate and direction of rotation of the motor 312 based upon the position of the drive nut 322 or drive bar connector 324.

As will be understood by one of ordinary skill in the art, rotation of the drive screw 320 can result in translation of the drive nut 322 along a longitudinal axis A (FIG. 9) of the drive screw. Other actuators that provide linear translation are also contemplated. When the drive nut 322 contacts one of the actuation surfaces 326 of the drive bar connector 324, continued rotation of the drive screw 320 results in continued translation of the drive nut 322, which causes translation of the drive bar connector 324 and the drive bar 148, respectively.

In the illustrated embodiment of FIGS. 8 and 9, upward translation of the drive bar connector 324 can result in motion of the multipoint lock 300 from the latched position, past the extended position, to the locked position.

Figure 10A:
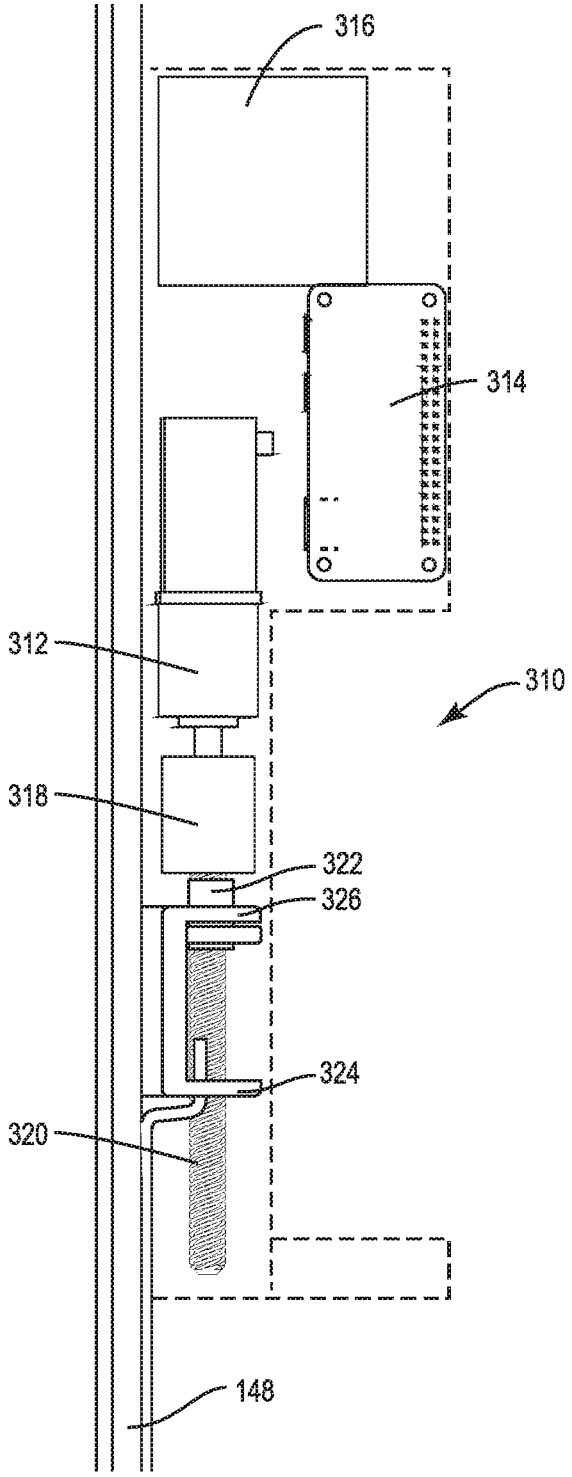
FIGS. 10A-10D illustrate a sequence of positions of the powered actuator to operate multipoint locks according to embodiments of the present disclosure.
Figure 10B:
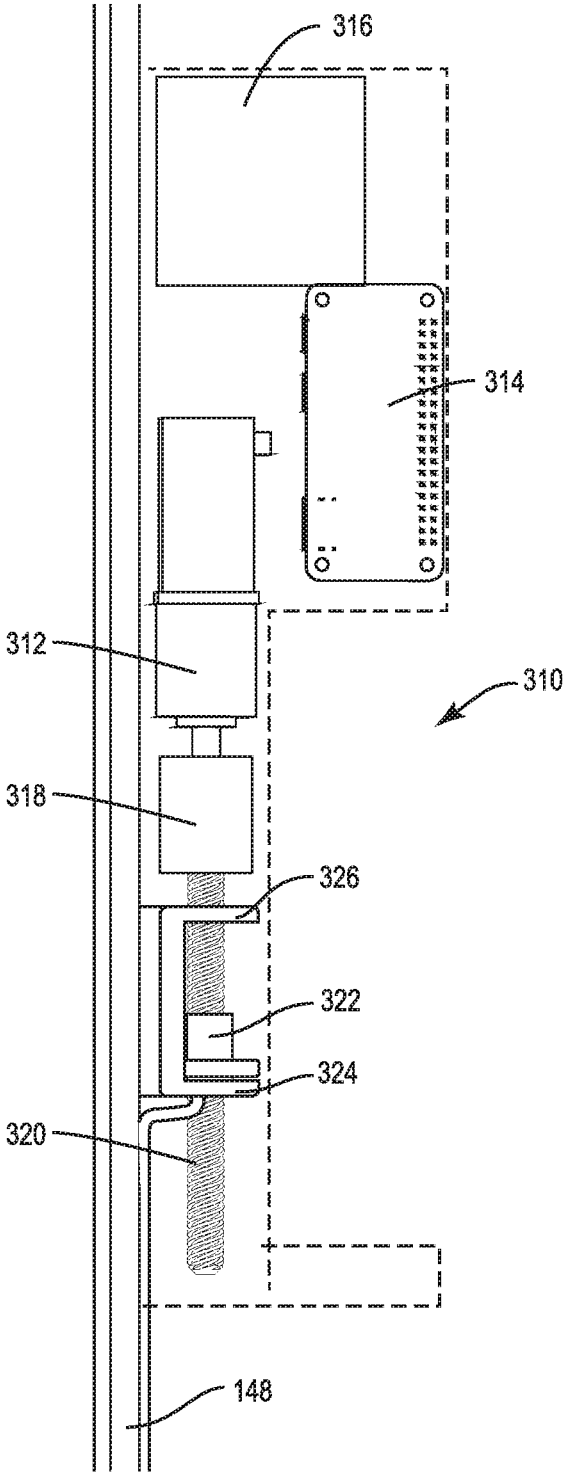
Figure 10C:
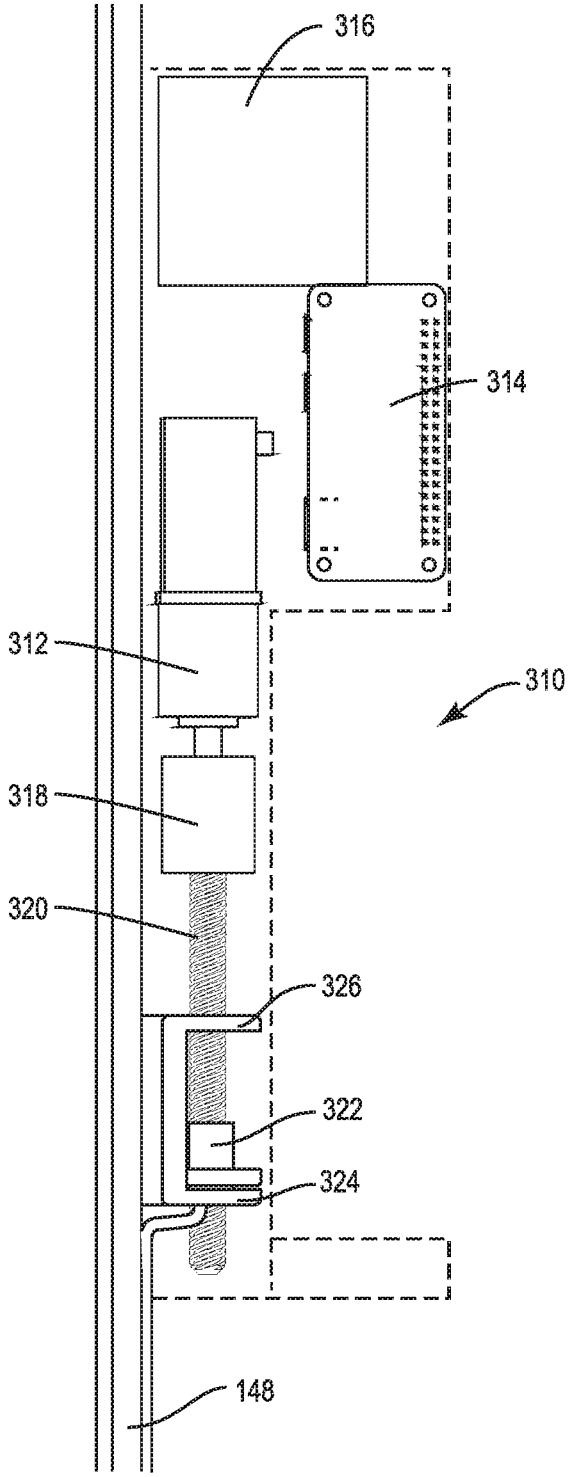
Figure 10D:
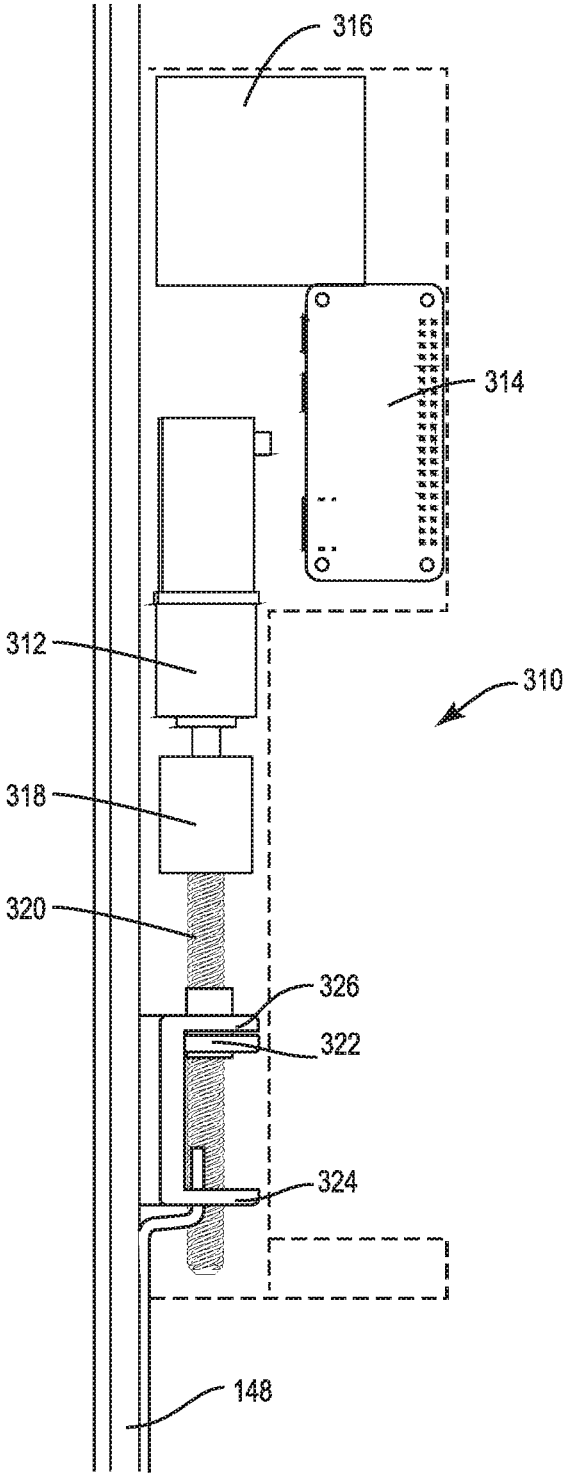

FIGS. 10A-D illustrate relative positioning of components within the multipoint lock 300 that allow for co-existence of manual and powered operation. FIG. 10A shows an upward extreme position of the drive nut 322, which corresponds with the act of extending the center latch 306 (FIG. 7) and the auxiliary latches 302 with the powered actuator 310. In one embodiment, the controller 314 is then configured to reverse the motor 312 to lower the drive nut 322 to a neutral, intermediate position shown in FIG. 10B. With the drive nut 322 in the neutral position, the latches 302, 306 can be withdrawn using the thumb turn drive hub 116 (FIG. 7) because the drive bar 148 and drive bar connector 324 can be lowered without being impeded by the drive nut 322. Additionally, lowering the drive nut 322 with the motor 312 to a second extreme position shown in FIG. 10C will force the drive bar 148 downward in the illustrated embodiment, and move the multipoint lock 300 into the latched, unlocked position, withdrawing the latches 302, 306 from their deadbolt positions. Again, the drive nut 322 may be caused to return again to the intermediate, neutral position as shown in FIG. 10D after the multipoint lock 300 is placed into the latched position. From the arrangement of FIG. 10D, the drive bar 148 can be manually raised to extend the latches using upward rotation upon the handle lever 18 (FIG. 1) as discussed above.

Figure 11:
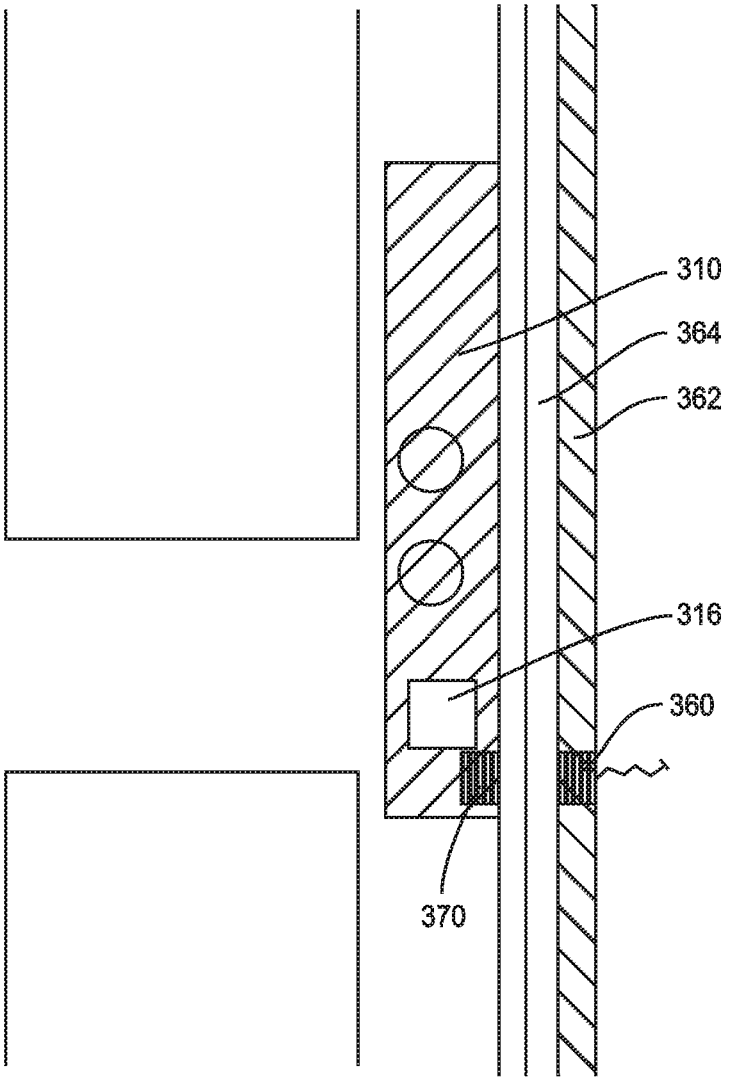
FIG. 11 is a schematic of an exemplary embodiment for maintaining charge in the power source of the multipoint lock of FIG. 7.

To operate the motor 312 and other electrical components of the powered actuator 310, the power source 316 may take the form of a battery pack, such as a rechargeable battery. Preferably, the power source 316 is replenished without accessing the power source, e.g. without replacing the batteries. FIG. 11 schematically illustrates a first embodiment in which the power source 316 is re-energized using an inductive charging system. A primary coil 360 may be installed on a rough opening frame 362 or a door jamb 364. The primary coil 360 could be hard wired to the main power supply of the house, such as the electrical grid. A secondary coil 370 may be incorporated into the powered actuator 310 and operably coupled to the power source 316. When the door panel is closed, the primary coil 360 should be within sufficient proximity to the secondary coil 370 to transfer energy via an electromagnetic field from the primary coil to the secondary coil, allowing the power source 316 to be re-energized.

In another, potentially less preferred embodiment (not shown), the power source 316 may be charged, or provided in the first instance, by being hard wired to the building's main source of electricity. For example, electrical energy could pass from the building to the door panel through the hinges of the door panel and travel by wire from the hinge to the power source 316. In a further embodiment, a solar cell could be mounted to an exterior face of the door panel to collect energy from the sun to be stored within the batteries of the power source 316.

Embodiments reflected in the description above may be characterized in part by the following paragraphs:

Paragraph 1: A lock, comprising:

a latch; and a powered actuator, wherein the powered actuator is configured to extend the latch from a latched position to a locked position, wherein, in the latched position, the latch extends from an edge of a door panel by a first distance, and wherein, in the locked position, the latch extends from an edge of the door panel by a second distance, the second distance being greater than the first distance.

Paragraph 2: The lock of Paragraph 1, wherein the latch is capable of being manually returned from the locked position to the latched position.

Paragraph 3: The lock of Paragraph 1, further comprising a controller configured to receive a wireless signal to initiate operation of the powered actuator.

Paragraph 4: The lock of Paragraph 3, wherein the controller is configured to operate the powered actuator to position a lock nut in a first position to lock the lock, a second position to unlock the lock, and a third position between the first and second positions to provide clearance for manual operation of the lock between a locked position and an unlocked position thereof.

Paragraph 5: The lock of Paragraph 1, further comprising an inductive charging system configured to wirelessly re-energize a power source of the powered actuator.

Paragraph 6: The lock of Paragraph 1, further comprising at least one auxiliary latch capable of being extended by the powered actuator simultaneously with the latch.

Paragraph 7: The lock of Paragraph 1, wherein the powered actuator comprises:

a motor connected to a drive screw, the drive screw capable of rotational movement in two directions;

a drive nut on the drive screw, the drive nut capable of linear movement in two directions to translate a drive bar connector;

a drive bar capable of linear movement in two directions in response to translation of the drive bar connector; and a drive plate capable of linear movement in two directions in response to movement of the drive bar, wherein the latch extends or withdraws in response to movement of the drive plate.

Although the above disclosure has been presented in the context of exemplary embodiments, it is to be understood that modifications and variations can be utilized without departing from the spirit and scope of the invention, as those skilled in the art will readily understand. Such modifications and variations are considered to be within the purview and scope of the appended claims and their equivalents.

The invention claimed is:

1. A multipoint lock for securing a door panel, comprising:

a first latch;

a second latch;

a first hub rotatable with at least one of a thumb-turn knob or a key; and a second hub rotatable with a handle lever, wherein rotation of the handle lever from a neutral position in a first direction causes rotation of the first hub and rotation of the second hub in the same rotational direction such that the first latch and the second latch are extended, and wherein rotation of the handle lever from the neutral position in a second direction, opposite the first direction, causes rotation of the second hub with the first hub remaining stationary.

2. The lock of claim 1, further comprising a center latch disposed between the first latch and the second latch.

3. The lock of claim 2, wherein rotation of the handle lever in the first direction causes the center latch to extend from a first non-zero distance outside of the door panel to a second, greater distance outside of the door panel.

4. The lock of claim 3, wherein rotation of the handle lever in the second direction retracts the center latch to a third distance from the door panel less than the first non-zero distance.

5. The lock of claim 1, wherein a drive plate slides within a mortise box to coordinate rotation of the second hub with rotation of the first hub.

6. The lock of claim 1, wherein the first hub is operably connected to the first latch and the second latch such that rotation of the first hub in a first direction is configured to extend the first latch and the second latch substantially simultaneously, and rotation of the first hub in a second direction is configured to retract the first and second latch substantially simultaneously.

7. The lock of claim 1, further comprising an anti-slam device configured to prevent extension of the first and second latch when the door panel is in an open position.

8. The lock of claim 1, wherein the door panel is a passive door of a double door set.

9. The lock of claim 1, wherein the first and second latches comprise shoot bolts configured to extend from a top and a bottom of the door panel.

10. The lock of claim 1, wherein the first and second latches comprise auxiliary latches configured to extend from an unhinged edge of the door panel.

11. A multipoint lock for securing a door panel, comprising:

a first latch;

a second latch;

a first hub rotatable with at least one of a thumb-turn knob or a key; and a second hub rotatable with a handle lever, wherein rotation of the handle lever from a neutral position in a first direction causes rotation of the first hub and rotation of the second hub in the same rotational direction such that the first latch and the second latch are extended, wherein rotation of the handle lever from the neutral position in a second direction, opposite the first direction, causes rotation of the second hub, and wherein additional rotation of the first hub in the same rotational direction, without use of the handle lever, secures the first latch and the second latch in a locked position.

12. The lock of claim 11, wherein the first latch and the second latch are secured in the locked position by a lockout pin engaging the first hub.

13. The lock of claim 11, wherein the additional rotation of the first hub further extends the first latch and the second latch.

14. A method of operating a multipoint lock, comprising:

lifting a handle lever such that a first latch and a second latch are extended and a thumb turn drive hub is rotated in a first direction; and further rotating the thumb turn drive hub in the first direction with one of a key or a thumb-turn knob such that the multipoint lock is locked with the first latch and the second latch in an extended position.

15. The method of claim 14, comprising unlocking the multipoint lock by rotating the thumb turn drive hub in a second direction, opposite the first direction, with one of the key or the thumb-turn knob, wherein unlocking comprises withdrawing the first latch.

16. The method of claim 15, further comprising withdrawing the first latch by rotating the handle lever in a downward direction before further rotating the thumb turn drive hub.

17. The method of claim 14, wherein the step of further rotating the thumb turn drive hub is configured to prevent downward rotation of the handle lever.

18. The method of claim 14, further comprising engaging a lockout pin with the thumb turn drive hub.

19. The method of claim 14, further comprising depressing an anti-slam device prior to locking the multipoint lock.

* * * * *